United States Patent [19]

Lacasse

[11] 4,406,215

[45] Sep. 27, 1983

[54] DRIVE CYLINDER

[76] Inventor: Ernest Lacasse, 24, Place Vieux-Moulin, St. Romuald, Quebec, Canada

[21] Appl. No.: 247,858

[22] Filed: Mar. 26, 1981

[51] Int. Cl.[3] ..... F01B 11/02; F01B 7/00

[52] U.S. Cl. ..... 92/85 R; 92/85 B; 92/138; 92/165 PR

[58] Field of Search ..... 92/165 PR, 138, 165 R, 92/151, 85 B, 85 R

[56] References Cited

U.S. PATENT DOCUMENTS

| | | | |
|---|---|---|---|
| 676,523 | 6/1901 | Wood | 92/165 R |
| 1,281,490 | 10/1918 | Billado | 92/138 |
| 1,954,489 | 4/1934 | Partlow | 92/138 |
| 3,079,786 | 3/1973 | Fowler . | |
| 3,447,423 | 6/1969 | Henry | 92/85 B |
| 3,805,672 | 4/1974 | Pekrul | 92/85 B |
| 3,988,968 | 11/1976 | Peters et al. . | |
| 4,013,385 | 3/1977 | Peterson . | |

*Primary Examiner*—Paul E. Maslousky

*Attorney, Agent, or Firm*—Steele, Gould & Fried

[57] ABSTRACT

The drive cylinder comprises: an elongated rigid element having an internal chamber in which is located a rod guide dividing the chamber into two compartments; the rod, adapted to move longitudinally within the chamber, carries at one end a piston accommodated in one compartment and, at the other end, a head accommodated in the other compartment; a longitudinal aperture is arranged in the body of the cylinder, allowing a drive finger, secured to the head of the rod, to extend to the outside of the rigid element and to impart, to a slide carried by the cylinder, a longitudinal movement parallel with the axis of the cylinder.

3 Claims, 3 Drawing Figures

DRIVE CYLINDER

The present invention relates to a drive cylinder to which it is possible to attach a variety of operative components such as plungers, stationary or rotary cutting tools, attachments, bearings, sundry heads, etc.

Certain components in large automatic machines are required to execute continuous reciprocating motions in rather confined areas. Such motions are usually carried out by means of pneumatic, hydraulic or other cylinders. The component displaced by the connecting rods of such cylinders is normally located in an extension of the rod, the movement being therefore along the axis of displacement of the connecting rod. It is essential, however, to ensure that these movements are carried out very accurately, in order to avoid any jamming of the connecting rod in the cylinder, which occurs quite frequently if the load does not act along the axis of the cylinder.

It is an object of the present invention to provide a cylinder which will permit a component to be displaced in a plane parallel with the plane of displacement of the rod; thus the cylinder is designed in such a manner that any loads other than those applied along the axis of displacement of the rod will be transferred to the body of the cylinder, rather than to the rod.

The present invention therefore relates to a drive cylinder comprising: an elongated rigid element having an internal chamber closed at both ends; a guide secured in the interior of the chamber and dividing it into two compartments; a rod, running in the guide and adapted to move longitudinally within the chamber, the opposite ends of the rod each being accommodated in one of the compartments; the rod carries, at one end, a piston located in one compartment and, at the other end, a head located in the other compartment. An inlet and an outlet are provided in the first compartment for a supply of fluid used to displace the piston. Arranged in the second compartment of the rigid element are a longitudinal aperture and a drive finger which is secured to the head of the rod and extends, through the aperture, to the outside. Displacement of the piston thus produces longitudinal displacement of the finger externally of the rigid element, the displacement being parallel with that of the piston.

According to one embodiment of the invention, a slide is secured to the drive finger and moves in a groove machined into the outer wall of the rigid element; the slide is thus carried by the cylinder.

The drive cylinder according to the present invention thus permits the part associated with, and displaced by, the rod to bear upon the cylinder, the loads applied to the piston being transferred to the cylinder itself which, in turn, is secured to the frame of the machine upon which it is mounted.

Other characteristics and advantages of the invention may be gathered from the following description of an example of embodiment of the drive cylinder, in conjunction with the drawing attached hereto, wherein.

Figures 1, 2, 3:
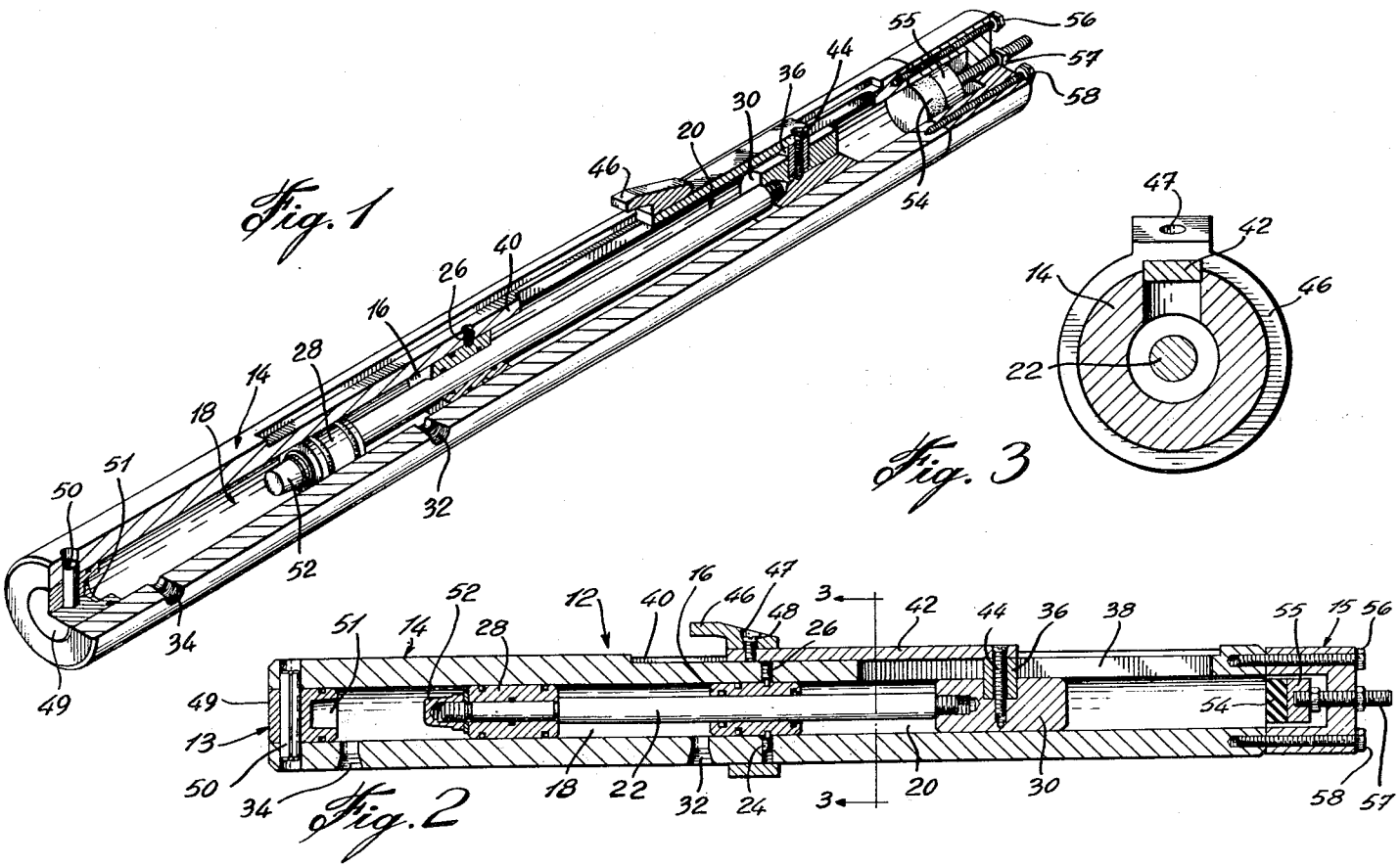
FIG. 1 is a perspective view of a drive cylinder according to the invention.
FIG. 2 is a longitudinal axial cross-section of the cylinder illustrated in FIG. 1.
FIG. 3 is a cross-section along the line 3—3 in FIG. 2.

FIGS. 1, 2 and 3 illustrate a drive cylinder 12 according to the invention, the cylinder comprising an elongated, rigid, cylindrical element 14 containing a chamber closed at both ends 13,15. A guide 16 divides this chamber into two compartments 18,20 sealed off from each other and supports a rod 22 which passes therethrough and extends into each of the two compartments. Guide 16 is held in position within the chamber by means of set screws, of which two are shown at 24 and 26.

In compartment 18, defined by the internal wall of the cylinder, guide 16 and end 13, piston 28 is secured to the end of rod 22 and is adapted to slide upon the internal wall of the compartment. In compartment 20, defined by the internal wall of the cylinder, guide 16 and end 15, a head 30 is secured to the other end of rod 22 and may also slide upon the internal wall of this second compartment.

Compartment 18 comprises inlet and outlet ports 32 and 34 for the supply and return of fluid for displacement of the piston. Pressure is thus applied to the piston by a fluid or compressed air and the piston transmits a thrust to the rod.

A drive finger 36 is secured to head 30 on the rod. This finger passes to the outside of the cylinder through an elongated aperture 38 arranged in the wall thereof. In this area, a groove 40 is arranged in the outer wall of the cylinder, the shape of the groove matching that of a slide 42 secured to drive finger 36. A screw 44 secures the slide to the finger and to head 30 on the rod. Item 46 is a diagrammatical representation of the various components that may be attached to slide 42 and will thus be displaced longitudinally and in parallel with the axis of displacement of rod 22. Item 46 is fitted with a hole 47 to accommodate an attachment screw 48.

End 13 of the cylinder comprises a damping pad 49 secured to the cylinder by means of a dowel 50; the internal surface of the pad has a cavity 51 adapted to accommodate bolt 52 which secures the piston to the rod. End 15 has a damping pad 54 secured to the cylinder by means of a part 55 and an arrangement of screws 56,57,58.

The cylinder is operated by using a fluid or compressed air to apply pressure to one of the surfaces of piston 28 which transmit thrust to rod 22 which transfers the thrust to head 30. Guide 16 prevents the rod from being deflected when subjected to the thrust from the piston.

It will thus be seen that, with the present invention, the weight and loading applied by component 46 to be displaced are absorbed by the cylinder, more particularly by groove 40 and the internal walls of compartments 18 and 20.

The embodiments of the invention in which an exclusive property or privilege is claimed are defined as follows:

1. A drive cylinder comprising: an elongated rigid element having an external wall and a continuous internal chamber closed at both ends; a guide fixedly contained within said chamber and dividing said chamber into two compartments; a rod running in said guide and adapted to move longitudinally in said chamber, the opposite ends of said rod being accommodated respectively in said compartments; a piston fitted to one end of the rod in one compartment; a head fitted to the other end of the rod in the other compartment; inlet and outlet ports in the first compartment for supplying fluid to and discharging fluid from the interior thereof for displacement of the piston therein; said rigid element having, in the second compartment, a longitudinal aperture, the opposite ends of the rigid element including within said chamber, pads serving as damping stops for the piston and the head; a drive finger, secured to said head on the rod, extending externally of said rigid element, through said aperture, in such a manner that displacement of said piston produces longitudinal displacement of said drive finger externally of said rigid element, said displacement of the drive finger being parallel with the displacement of said piston; and a slide fixedly attached to said drive finger and supported on the exterior wall of said rigid element, whereby loads, other than those exerted along the axis of said displacement of said drive finger, are exerted on said wall.

2. A drive cylinder according to claim 1, in which the head bears upon, and slides along, the internal wall of the second compartment.

3. A drive cylinder according to claim 1, comprising a groove in the external wall of the rigid element, said groove serving to accommodate said slide and to allow it to slide.

* * * * *